US008403422B2

(12) United States Patent
Wu

(10) Patent No.: US 8,403,422 B2
(45) Date of Patent: Mar. 26, 2013

(54) STOOL

(75) Inventor: Chung-Yen Wu, Taipei (TW)

(73) Assignee: Pegatron Corporation, Ligong St., Beitou District, Taipei (TW)

( * ) Notice: Subject to any disclaimer, the term of this patent is extended or adjusted under 35 U.S.C. 154(b) by 209 days.

(21) Appl. No.: 13/039,327

(22) Filed: Mar. 3, 2011

(65) Prior Publication Data

US 2011/0215631 A1 Sep. 8, 2011

(30) Foreign Application Priority Data

Mar. 5, 2010 (TW) ..... 99203936 U

(51) Int. Cl.
*A47C 7/00* (2006.01)

(52) U.S. Cl. ..... 297/440.12

(58) Field of Classification Search ..... 297/440.12
See application file for complete search history.

(56) References Cited

U.S. PATENT DOCUMENTS

| | | | | | |
|---|---|---|---|---|---|
| 2,361,875 | A | * | 10/1944 | Sachs | 108/165 |
| 3,566,808 | A | * | 3/1971 | Slate et al. | 297/440.12 X |
| 3,620,175 | A | * | 11/1971 | Crane et al. | 108/157.14 |
| 3,705,557 | A | * | 12/1972 | Budington | 108/150 |
| 3,714,908 | A | * | 2/1973 | Notko | 108/157.14 |
| 3,724,399 | A | * | 4/1973 | Notko et al. | 108/157.14 |
| 3,727,979 | A | * | 4/1973 | Schier et al. | 297/440.12 |
| 4,078,502 | A | * | 3/1978 | Barna | 108/150 |
| 4,340,251 | A | * | 7/1982 | Geoffroy-Dechaume | 297/440.12 |
| 4,546,941 | A | * | 10/1985 | Hildebrand | 297/440.12 X |
| 4,841,882 | A | * | 6/1989 | Ehrman | 297/440.12 X |
| 5,018,454 | A | * | 5/1991 | Negus | 108/150 |
| 6,206,473 | B1 | * | 3/2001 | Kondratiev | 297/440.12 X |
| 7,625,047 | B2 | * | 12/2009 | Bertele | 297/440.12 |
| 8,240,770 | B2 | * | 8/2012 | Bertele | 297/440.12 |

FOREIGN PATENT DOCUMENTS

GB 1215475 12/1970

* cited by examiner

*Primary Examiner* — Rodney B White
(74) *Attorney, Agent, or Firm* — Winston Hsu; Scott Margo

(57) ABSTRACT

A stool includes a polygonal fixing portion, a plurality of supporting portions, and a combining portion. The polygonal fixing portion includes a plurality of inserting slots, and each of the inserting slots is located between two adjacent sides. Each of the supporting portions includes a supporting sheet and two inserting flaps, and the inserting flaps extend from two sides of the supporting sheet and are inserted into the adjacent inserting slots to position the supporting portions at a side of the polygonal fixing portion. The combining portion includes a plurality of positioning slots. The positioning slots of the combining portion are fastened to the inserting flaps to combine the supporting portions to form a polygonal column.

11 Claims, 13 Drawing Sheets

STOOL

CROSS-REFERENCE TO RELATED APPLICATIONS

This Non-provisional application claims priority under 35 U.S.C. §119(a) on Patent Application No(s). 099203936 filed in Taiwan, Republic of China Mar. 5, 2010, the entire contents of which are hereby incorporated by reference.

BACKGROUND OF THE INVENTION

1. Field of the Invention

This invention relates to a stool and, more particularly, to a stool capable of being disassembled and assembled.

2. Description of the Related Art

With improvement of environmental consciousness, to protect the environment and reduce costs, stools made of corrugated paper are gradually developed on a market. The stools made of the corrugated paper not only protect the environment and reduce the costs, but also are convenient for a user to move due to the lightweight of the corrugated paper.

At present, the common stools made of the corrugated paper on the market usually use assistant elements, such as glue, a tape, a plastic object, a metal object and so on, to assemble the stools. Thus, when the stools are recycled and classified, it is inconvenient in resource classification.

Because the conventional stools made of the corrugated paper have poor carrying capacity and pressure resistance, the stools are deformed easily. Accordingly, some stools are designed for improving the carrying capacity and the pressure resistance and failed to have a containing space inside. Further, since the corrugated paper are adhered and fastened to form the stool, fastening structures are easy to be exposed.

BRIEF SUMMARY OF THE INVENTION

According to the above, an embodiment of this invention provides a stool including a polygonal fixing portion, a plurality of supporting portions, and a combining portion. The polygonal fixing portion includes a plurality of inserting slots, and each of the inserting slots is located between two adjacent sides. Each of the supporting portions includes a supporting sheet and two inserting flaps, and the inserting flaps extend from two sides of the supporting sheet and are inserted into the inserting slots to position the supporting portions at the side of the polygonal fixing portion. The combining portion includes a plurality of positioning slots, and the positioning slots of the combining portion are fastened to the inserting flaps to combine the supporting portions to form a polygonal column.

Further, the stool may further include a covering flap disposed at one end of the supporting sheet and combined with the inserting flaps. The covering flap includes a fastening slot, and the inserting flaps are inserted into the fastening slot to be combined with the covering flap.

In addition, the stool may further include at least one seat portion sleeved on one end of the supporting portions. The seat portion includes a main body portion including a plurality of combining tabs and a side portion including a first combining element, a second combining element, and a plurality of combining holes. The first combining element is combined with the second combining element, and the combining tabs are inserted into the combining holes to combine the main body portion and the side portion.

The side portion may further include a plurality of positioning flaps. Each of the positioning flaps includes a first positioning element and a second positioning element, and the first positioning element of one of the positioning flaps is combined with the second positioning element of the adjacent positioning flap to position the positioning flaps.

According to the embodiment in the invention, the supporting portions and the polygonal fixing portion are assembled with each other after folded, and then the supporting portions and the polygonal fixing portion are positioned by the combining portion to form a supporting structure having a containing space. Further, the seat portion is sleeved on the end of the supporting portions to form the stool. According to the structure design in the invention, carrying capacity and pressure resistance are improved, and the stool has the containing space capable of containing an object. Further, the problem that other assistant objects are needed for assembling in the prior art can be solved.

These and other features, aspects, and advantages of the present invention will become better understood with regard to the following description, appended claims, and accompanying drawings.

DETAILED DESCRIPTION OF THE INVENTION

A stool in one embodiment of this invention is preferably made of corrugated paper. However, the invention is not limited thereto. The stool may also be made of other paper or materials with a supporting function. The stool in the embodiment of the invention includes a plurality of supporting portions 10, a polygonal fixing portion 20, a combining portion 30, and a seat portion 40.

Figure 1A:
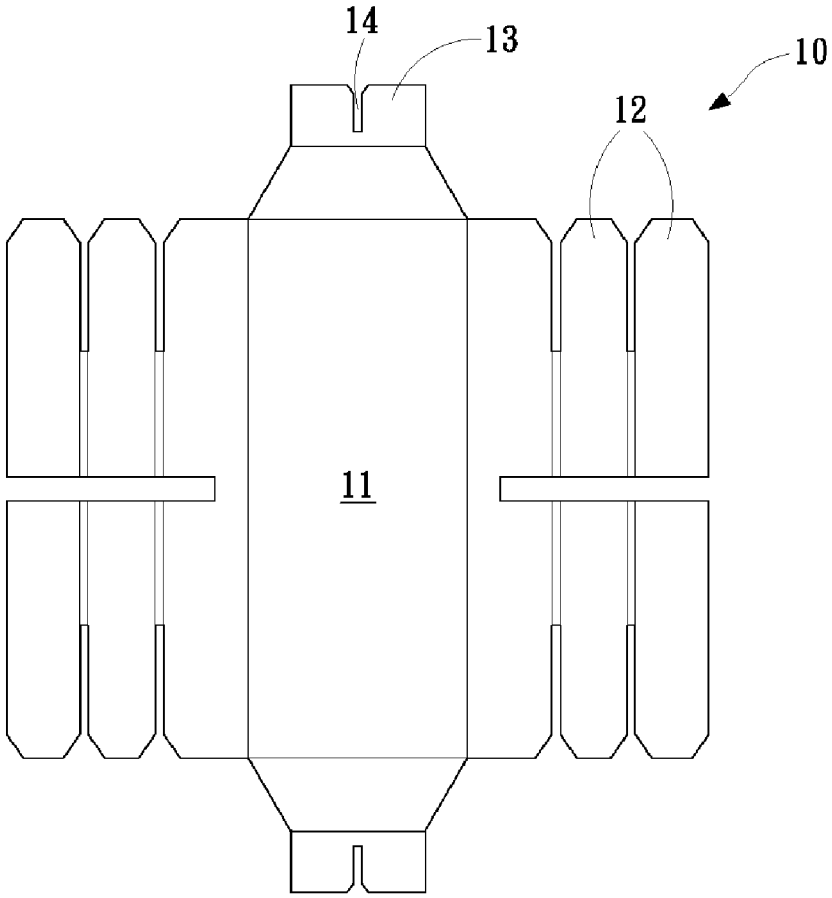
FIG. 1A is a planar diagram showing a supporting portion according to this invention.

FIG. 1A is a planar diagram showing the supporting portion 10 according to the invention. The supporting portion 10 mainly includes a supporting sheet 11 and two inserting flaps 12. The supporting sheet 11 is a rectangular sheet. The inserting flaps 12 are connected with the supporting sheet 11 at two sides, and the inserting flaps 12 extend from the two sides of the supporting sheet 11 and face to each other. Two covering flaps 13 are disposed at one end of the supporting sheet 11, respectively, and face to each other. Accordingly, the inserting flaps 12 and the covering flaps 13 are connected with the supporting sheet 11 at two adjacent sides, respectively. In addition, the covering flaps 13 further have fastening slots 14, and the fastening slots 14 are preferably funnel-shaped, such that the fastening slots 14 are easier to be inserted. The aforementioned shape of the fastening slots 14 is just taken for example, and the invention is not limited thereto. Any shape capable of achieving the inserting function is all within the scope of the invention.

Figure 1B:
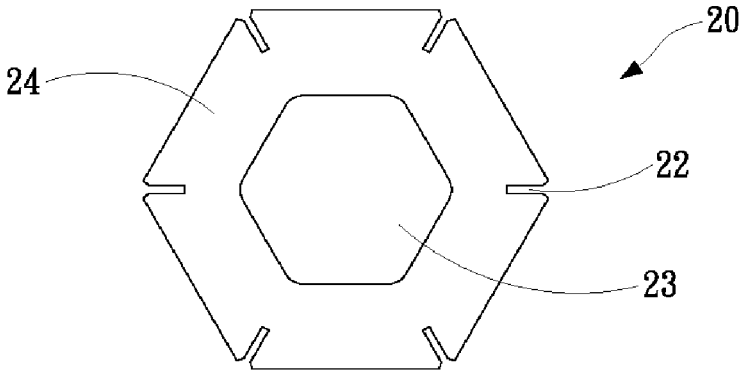
FIG. 1B is a planar diagram showing a polygonal fixing portion according to the invention.
Figure 3A:
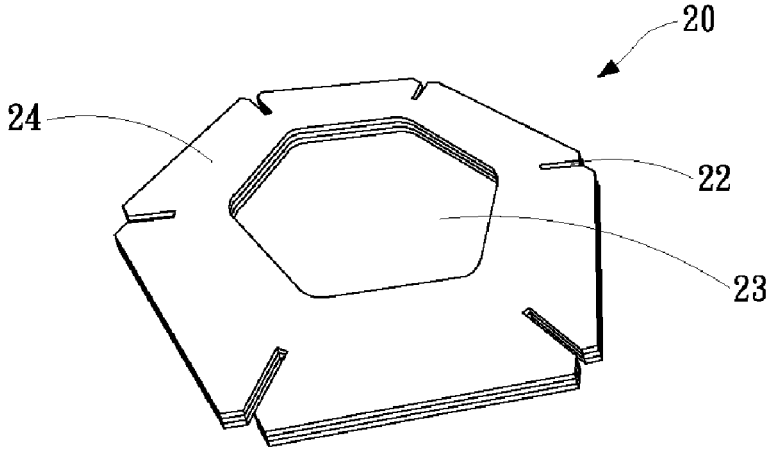
FIG. 3A is a first diagram showing an assembling process of a stool according to one embodiment of the invention.

FIG. 1B is a planar diagram showing the polygonal fixing portion 20 according to the invention. The polygonal fixing portion 20 is a polygonal sheet and is formed by stacking a plurality of corrugated boards 24, as shown in FIG. 3A. The polygonal fixing portion 20 has a plurality of inserting slots 22. In the embodiment of the invention, the polygonal fixing portion 20 is a regular hexagon. However, the invention is not limited thereto. The polygonal fixing portion 20 may be different polygons or regular polygons according to needs of the actual structure. Further, the inserting slots 22 are located between two adjacent sides, respectively, and the inserting slots 22 are preferably funnel-shaped, such that the inserting slots 22 are easier to be inserted. In addition, the polygonal fixing portion 20 further has a hollow through hole 23, and the hollow through hole 23 is preferably a polygonal opening hole. However, the invention is not limited thereto.

Figure 1C:
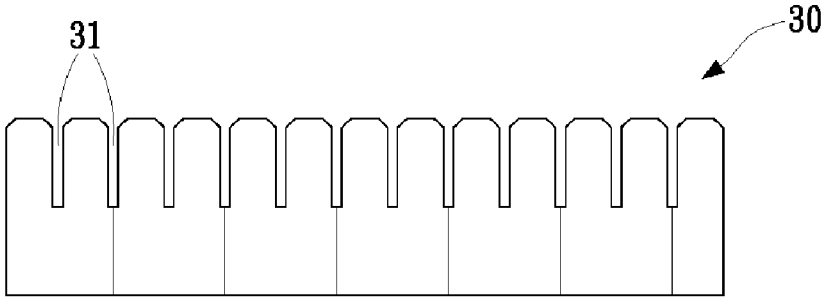
FIG. 1C is a planar diagram showing a combining portion according to the invention.

FIG. 1C is a planar diagram showing the combining portion 30 according to the invention. The combining portion 30 is a rectangular sheet and has a plurality of positioning slots 31. The positioning slots 31 are located at one side of the combining portion 30 and are disposed at intervals, and the positioning slots 31 are preferably funnel-shaped, such that the positioning slots 31 are easier to be inserted. The aforementioned shape of the positioning slots 31 is just taken for example, and the invention is not limited thereto. Any shape capable of achieving the inserting function is all within the scope of the invention.

Figure 2A:
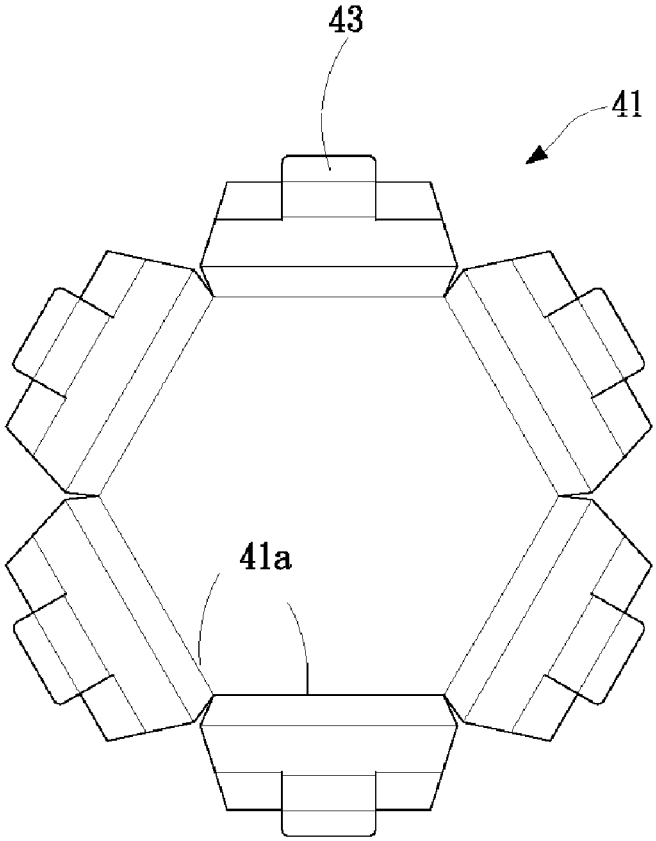
FIG. 2A is a planar diagram showing a combining tab according to the invention.
Figure 2B:
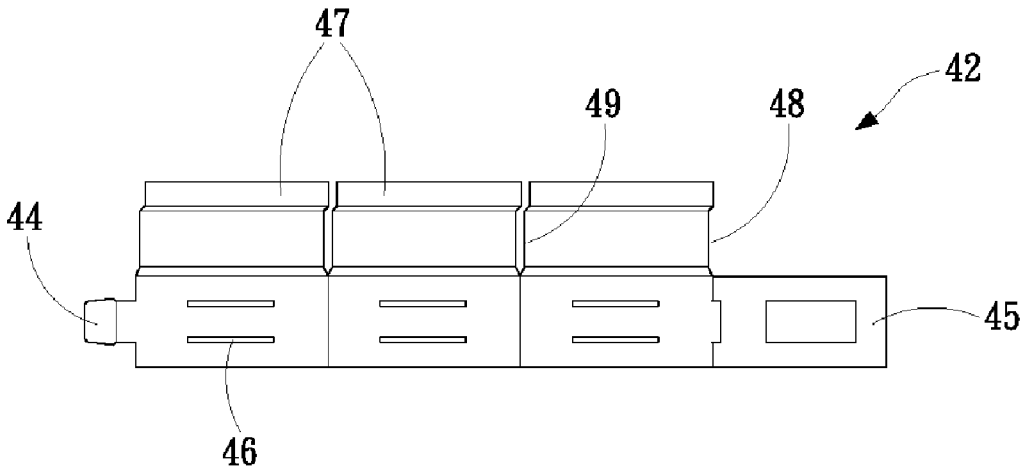
FIG. 2B is a planar diagram showing a side portion according to the invention.

Please refer to FIG. 2A, FIG. 2B, FIG. 2C, and FIG. 5. The seat portion 40 mainly includes a main body portion 41 and two side portions 42. FIG. 2B is a planar diagram showing the side portion 42 according to the invention. The aforementioned number of the side portion 42 is just taken for example. To reduce costs, the number of the side portion 42 may preferably be only one. FIG. 2A is a planar diagram showing a combining tab according to the invention. The main body portion 41 has a plurality of combining tabs 43, and the combining tabs 43 are ⊓-shaped sheets. The main body portion 41 has a plurality of edges 41*a*, and the combining tabs 43 are disposed at the edges 41*a*, respectively, and are connected with each other to form an approximate polygonal sheet. The number of the edges 41*a* in the embodiment of the invention is six thus to cooperate with the hexagonal shape of the polygonal fixing portion 20. However, the invention is not limited thereto. The number of the edges 41*a* can be increased or decreased according to the actual shape of the polygonal fixing portion 20. The side portion 42 is a rectangular sheet. The side portion 42 has a first combining element 44, and the first combining element 44 is located at one side of the side portion 42.

In addition, the side portion 42 further has a second combining element 45, and the second combining element 45 is an annular rectangular sheet. The second combining element 45 is located at one side of the side portion 42 and faces to the first combining element 44. Further, the side portion 42 has a plurality of combining holes 46. The combining holes 46 are openings shaped like slits, and every two combining holes 46 correspond to each other and are disposed at intervals. Accordingly, the side portion 42 further has a plurality of positioning flaps 47 corresponding to the combining holes 46 and disposed at one side of the side portion 42. Each of the positioning flaps 47 includes a first positioning element 48 and a second positioning element 49, and the first positioning element 48 and the second positioning element 49 are located at two sides of the positioning flap 47 and face to each other.

Figure 2C:
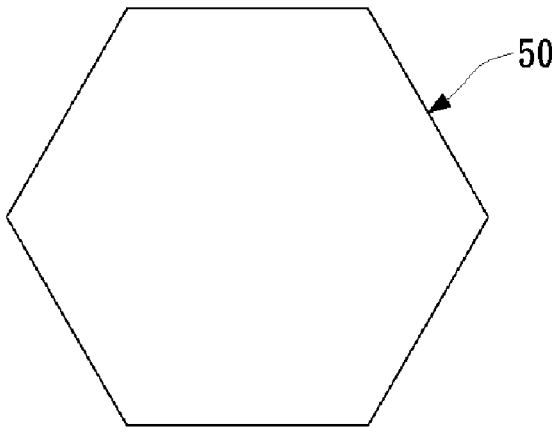
FIG. 2C is a planar diagram showing a strengthening sheet according to the invention.

Further, the seat portion 40 further has a strengthening sheet 50 located at the side portions 42 and attached to the main body portion 41. FIG. 2C is a planar diagram showing the strengthening sheet 50 according to the invention.

FIG. 3A to FIG. 3I are diagrams showing an assembling process of the stool according to one embodiment of the invention. In FIG. 3A, when the stool is to be assembled, the corrugated boards 24 are first stacked with each other to form the polygonal fixing portion 20. Since the corrugated boards have its own corrugated direction, when the corrugated boards 24 are stacked, the corrugated directions of the corrugated boards interlace with each other to strengthen the strength of the polygonal fixing portion 20. In the embodiment, the number of the corrugated boards 24 is preferably three. However, the invention is not limited thereto. When the corrugated boards 24 are stacked, the corrugated directions of the corrugated boards can be the same, and the number of the corrugated boards 24 can be increased or decreased according to needs of the actual structure.

Figure 3B:
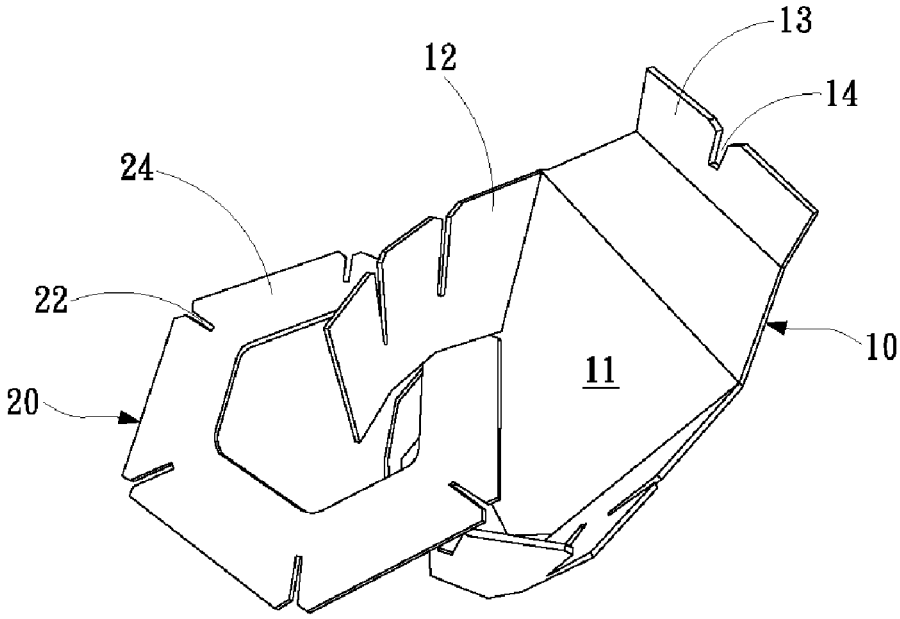
FIG. 3B is a second diagram showing the assembling process of the stool according to one embodiment of the invention.
Figure 3C:
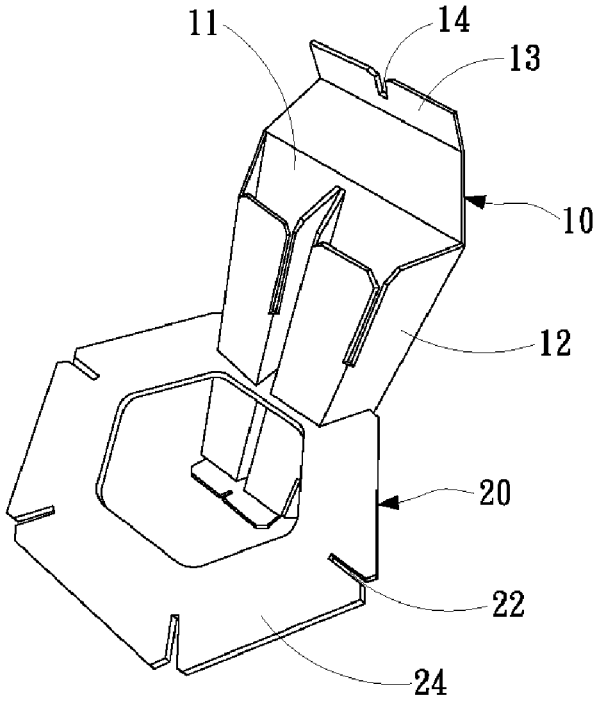
FIG. 3C is a third diagram showing the assembling process of the stool according to one embodiment of the invention.

Please refer to FIG. 3B to FIG. 3C. The inserting flaps 12 are first folded toward the supporting sheet 11, and the folded place is along the connection place of the inserting flaps 12 and the supporting sheet 11. Then, each of the inserting flaps 12 is folded toward the supporting sheet 11. At that moment, the supporting portion 10 is a column, and then the supporting portion 10 and the polygonal fixing portion 20 are assembled. The inserting flaps 12 are inserted into the adjacent inserting slots 22 thus to position the supporting portion 10 at one side of the polygonal fixing portion 20.

Figure 3D:
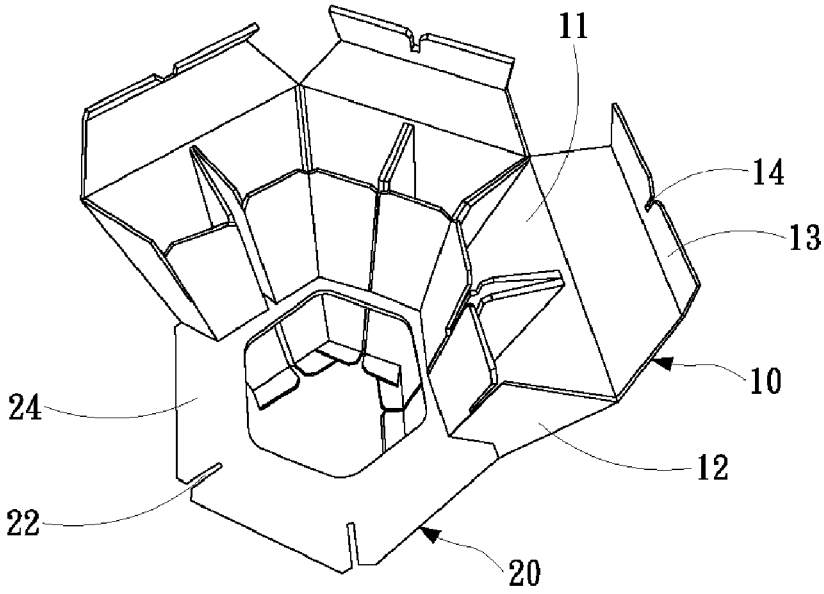
FIG. 3D is a fourth diagram showing the assembling process of the stool according to one embodiment of the invention.
Figure 3E:
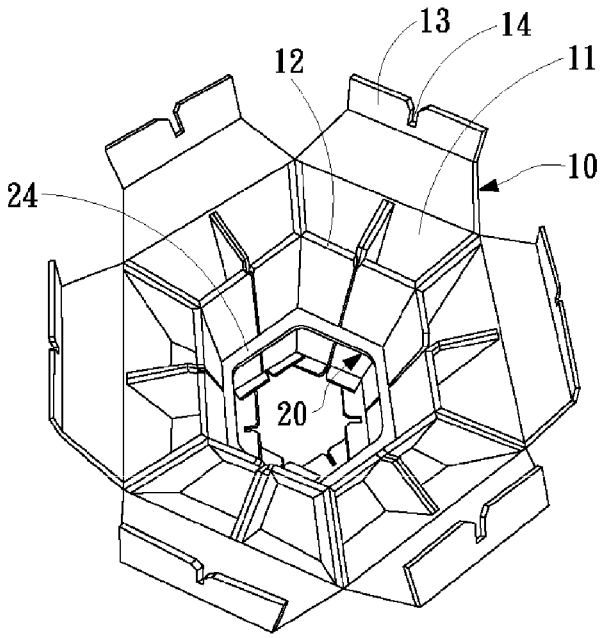
FIG. 3E is a fifth diagram showing the assembling process of the stool according to one embodiment of the invention.
Figure 3F:
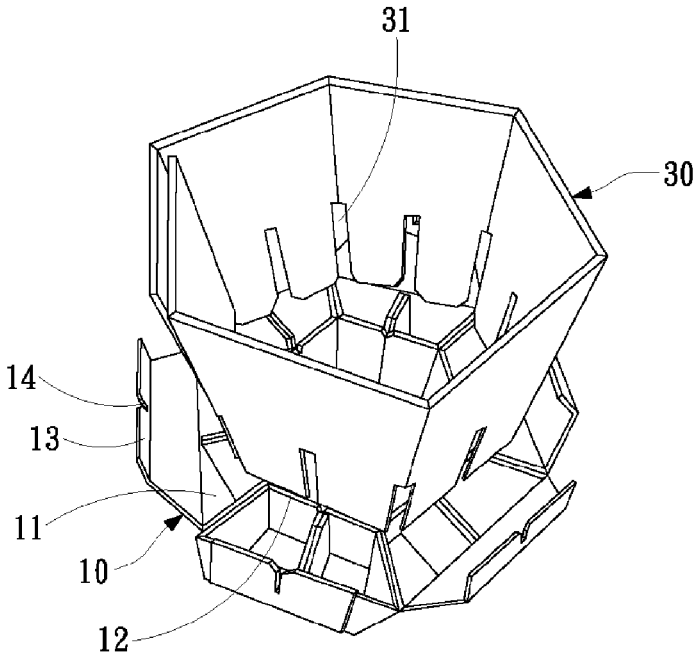
FIG. 3F is a sixth diagram showing the assembling process of the stool according to one embodiment of the invention.
Figure 3G:
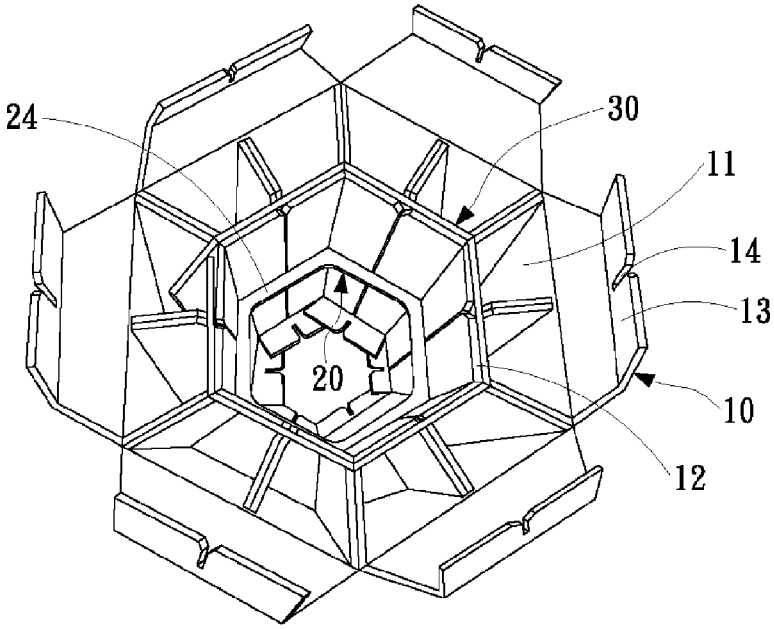
FIG. 3G is a seventh diagram showing the assembling process of the stool according to one embodiment of the invention.
Figure 3H:
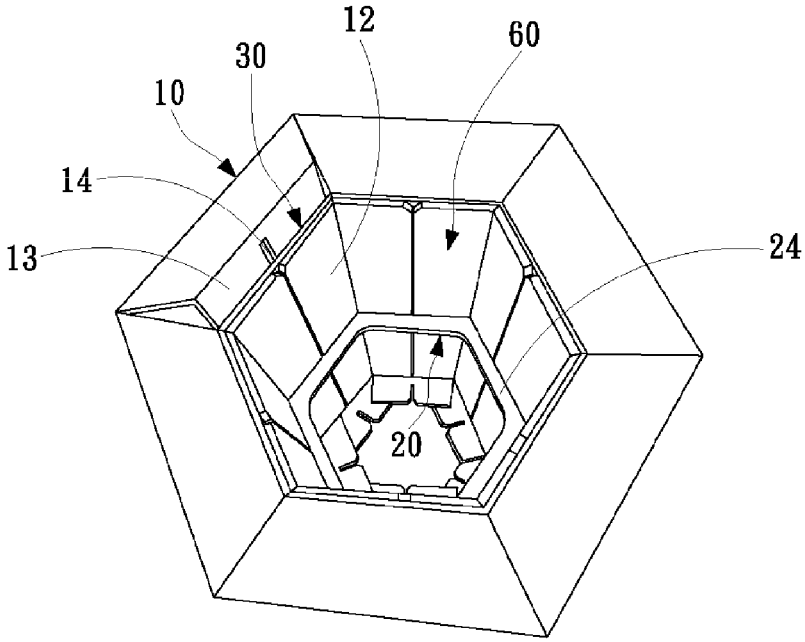
FIG. 3H is an eighth diagram showing the assembling process of the stool according to one embodiment of the invention.
Figure 3I:
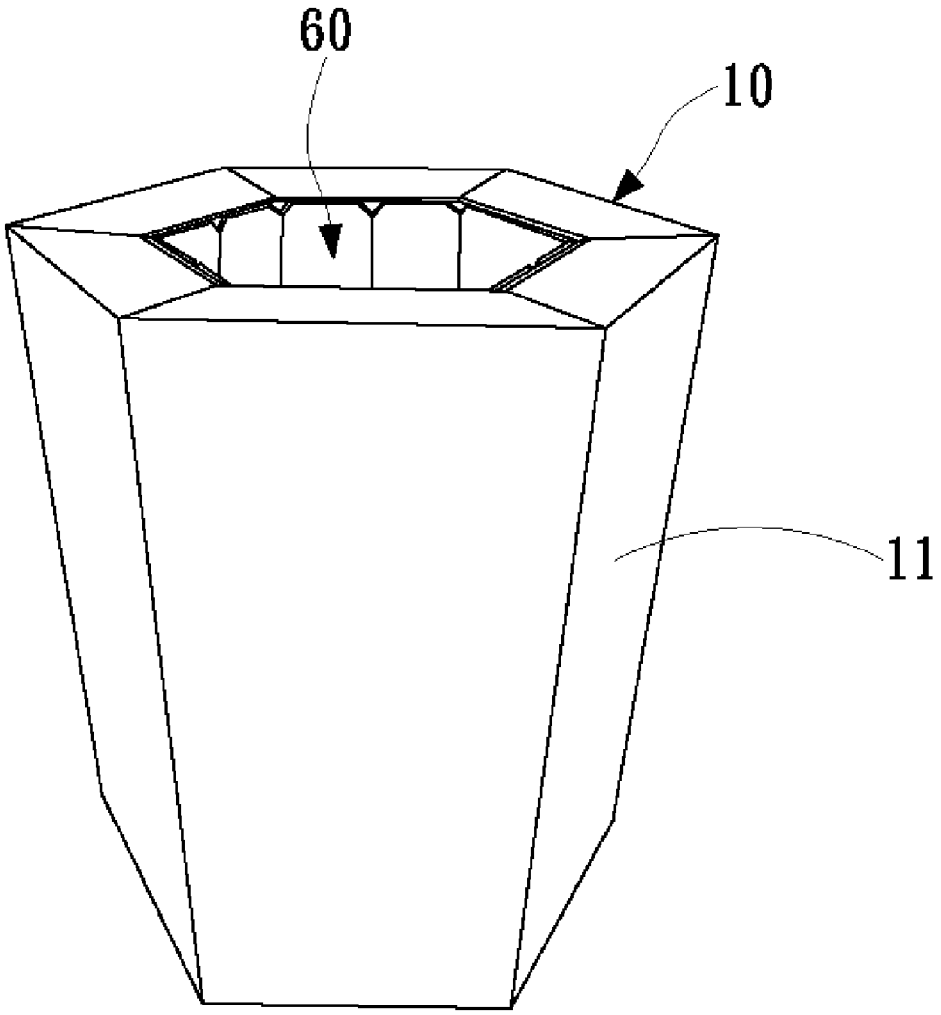
FIG. 3I is a ninth diagram showing the assembling process of the stool according to one embodiment of the invention.
Figure 4A:
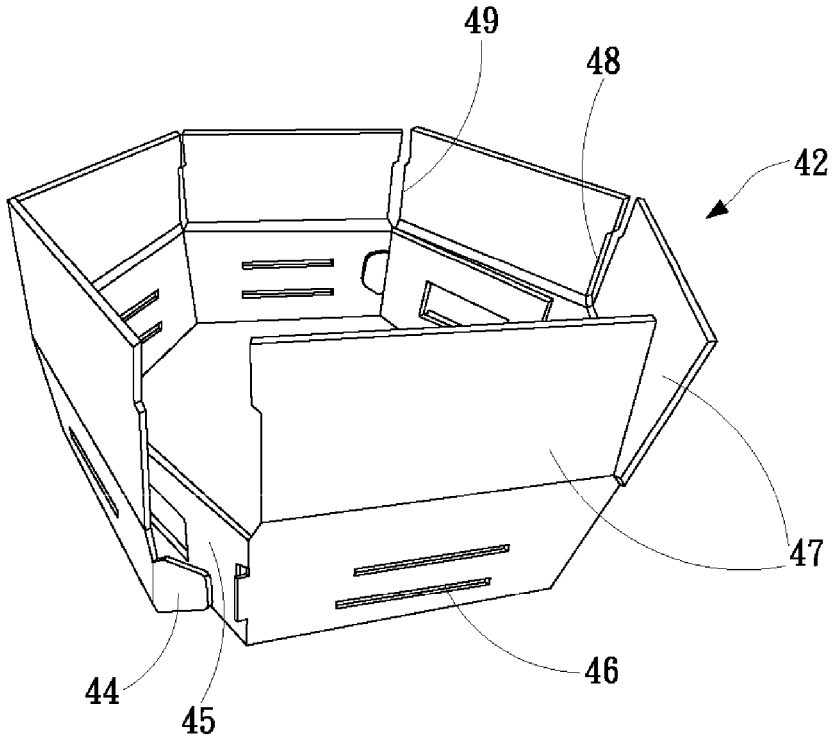
FIG. 4A is a first diagram showing an assembling process of a seat portion according to one embodiment of the invention.
Figure 4B:
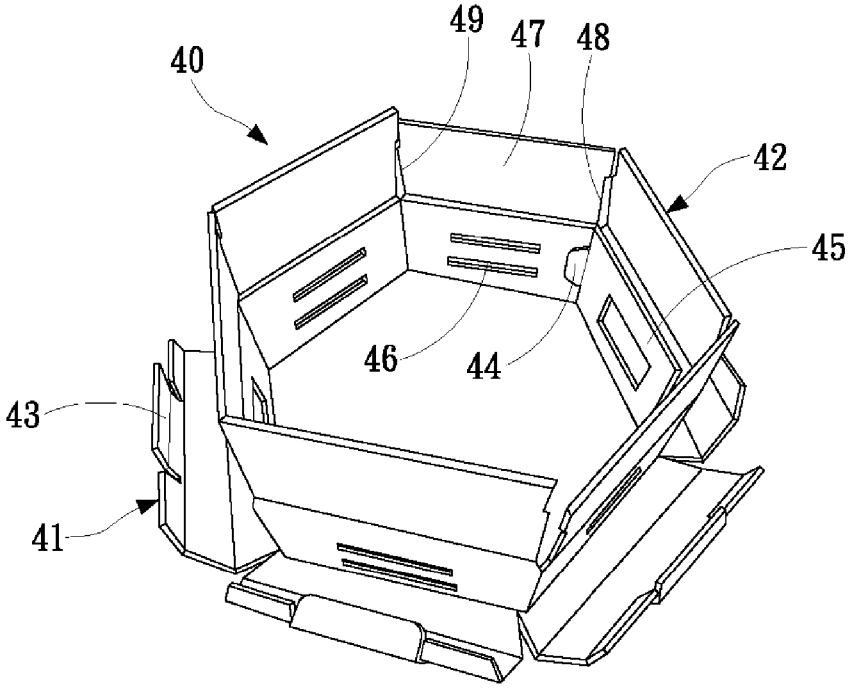
FIG. 4B is a second diagram showing the assembling process of the seat portion according to one embodiment of the invention.
Figure 4C:
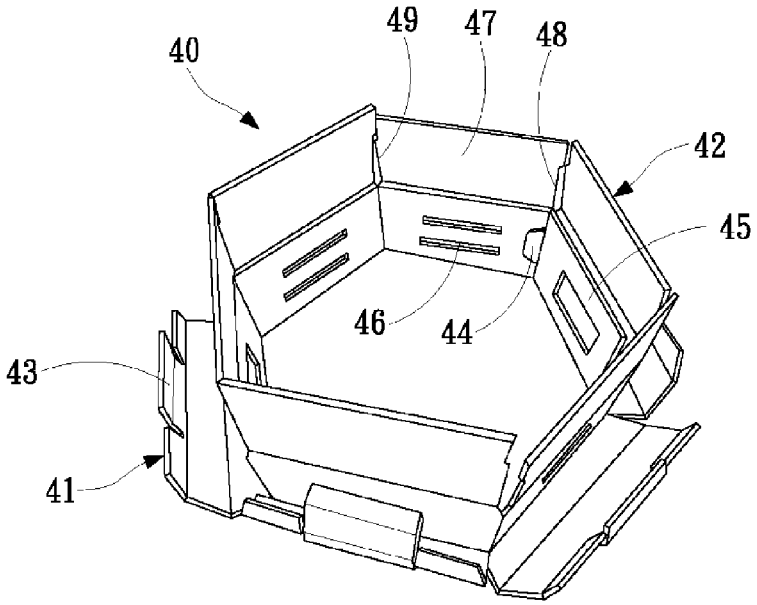
FIG. 4C is a third diagram showing the assembling process of the seat portion according to one embodiment of the invention.
Figure 4D:
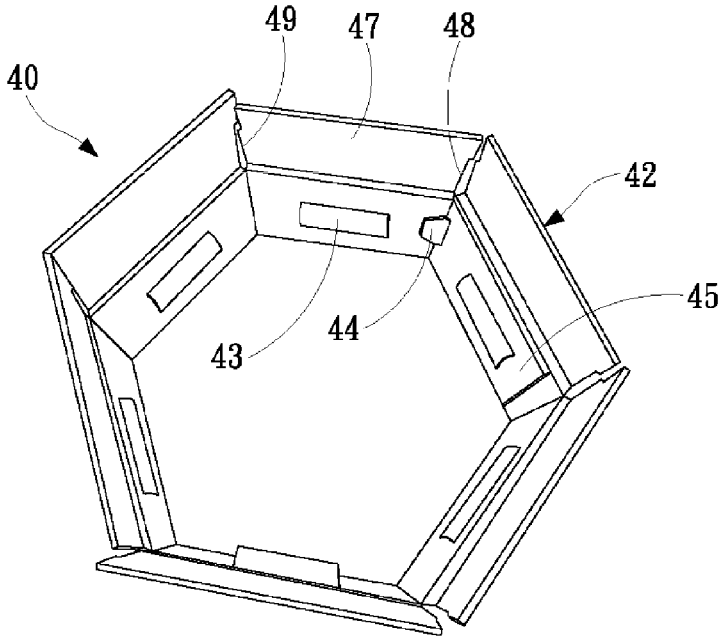
FIG. 4D is a fourth diagram showing the assembling process of the seat portion according to one embodiment of the invention.
Figure 4E:
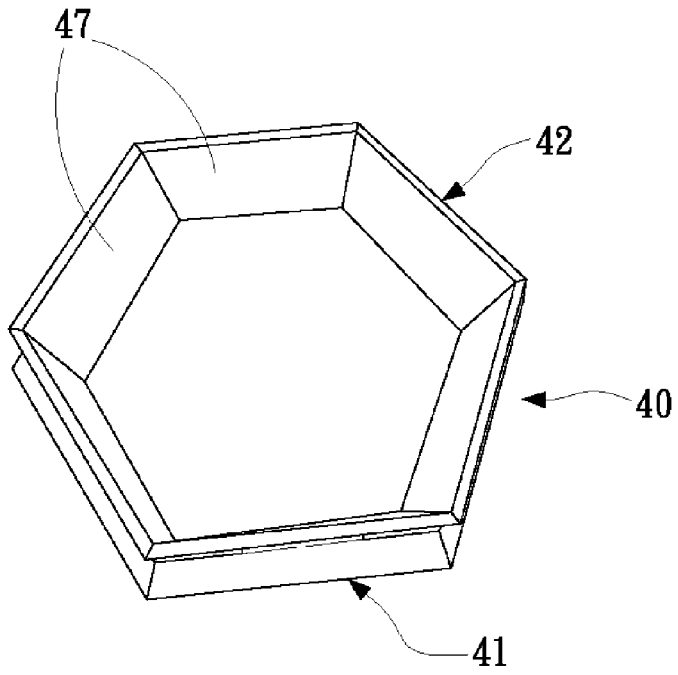
FIG. 4E is a fifth diagram showing the assembling process of the seat portion according to one embodiment of the invention.
Figure 4F:
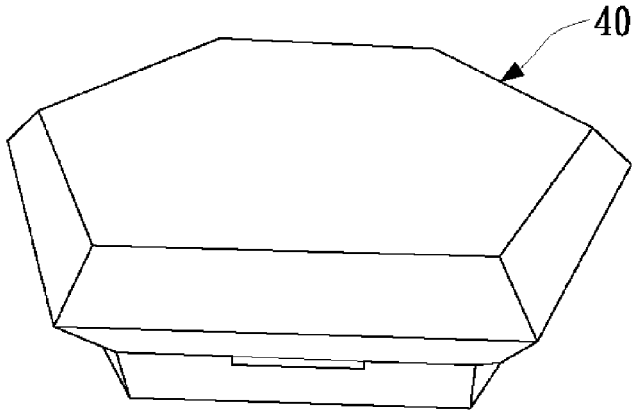
FIG. 4F is an appearance diagram showing a seat portion according to one embodiment of the invention.

Please refer to FIG. 3D to FIG. 3E. According to the same flow path, the remaining supporting portions 10 are assembled with the polygonal fixing portion 20 in sequence, such that every side of the polygonal fixing portion 20 is connected with the supporting portions 10.

Please refer to FIG. 3F to FIG. 3I. Then the combining portion 30 is combined with the supporting portions 10. In the embodiment, the combining portion 30 is first folded, such that the combining portion 30 forms an annular structure, and then the edge having the positioning slots 31 is inserted toward the supporting portions 10. The positioning slots 31 of the combining portion 30 are used for being fastened to the inserting flaps 12 to position and be combined with the supporting portions 10, thereby forming the polygonal column. The supporting portions 10 are positioned at the polygonal fixing portion 20 via the assembly of the combining portion 30, such that the supporting portions 10 are more firmly connected with the polygonal fixing portion 20 and a containing space 60 is formed among the supporting portions 10. At that moment, the hollow through hole 23 of the polygonal fixing portion 20 cooperating with the supporting portions 10 forms the containing space 60 inside the stool. Finally, the covering flaps 13 extended from one end of the supporting portions 10 are folded toward the inserting flaps 12, and after the covering flaps 13 are folded, the inserting flaps 12 are inserted into the fastening slots 14 to combine the covering flaps 13 and the inserting flaps 12. At the same time, the covering flaps 13 are located at one end of the supporting portions 10 and are used for covering the end of the supporting portions 10. Further, in the embodiment, the hollow through hole 23 of the polygonal fixing portion 20 may not be disposed. That is, the polygonal fixing portion 20 can divide the containing space 60 into two.

FIG. 4A to FIG. 4F are diagrams showing an assembling process of the seat portion according to one embodiment of the invention. Please refer to FIG. 4A to FIG. 4F. The seat portion 40 includes the main body portion 41 and the side portion 42. The first combining element 44 is combined with the second combining element 45 to form an annular structure. The number of the side portions 42 in the embodiment is two. The two side portions 42 are first combined with each other, and the first combining element 44 of the side portion 42 is combined with the second combining element 45 of the other side portion 42 to form the annular structure. At that moment, the combined side portions 42 are then placed on the main body portion 41 to allow the side portions 42 to be located at the edges of the main body portion 41. The combining tabs 43 are first inserted into the corresponding combining holes 46. In this step, the combining tabs 43 are first inserted into the combining hole 46 from the outside of the annular side portions 42, and then the combining tabs 43 are folded back from the inside of the side portions 42 and are inserted into the other combining hole 46. Each of the combining tabs 43 is inserted into the corresponding combining holes 46 in sequence to combine the main body portion 41 and the side portions 42. At the same time, each of the positioning flaps 47 is then folded toward the inside of the annular side portions 42. The first positioning element 48 of one of the positioning flaps 47 is combined with the second positioning element 49 of the adjacent positioning flap 47 to position the positioning flaps 47 to form the seat portion 40.

Figure 5:
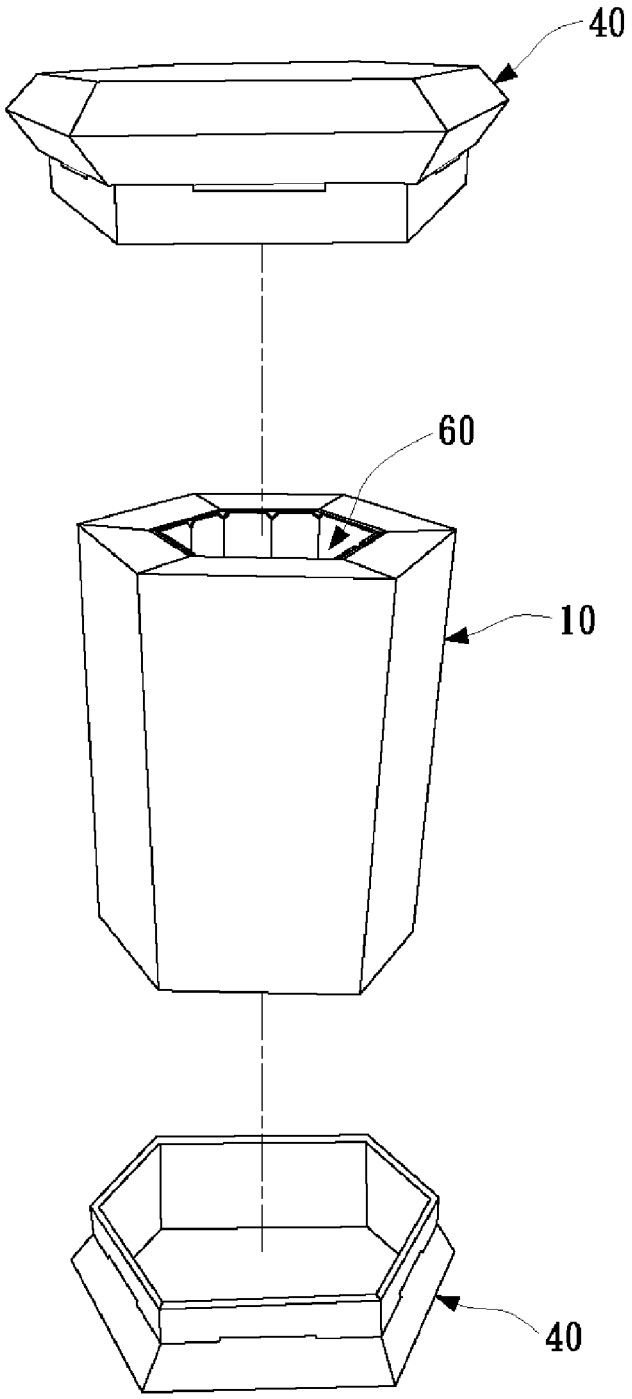
FIG. 5 is an assembled diagram showing a stool according to one embodiment of the invention.
Figure 6:
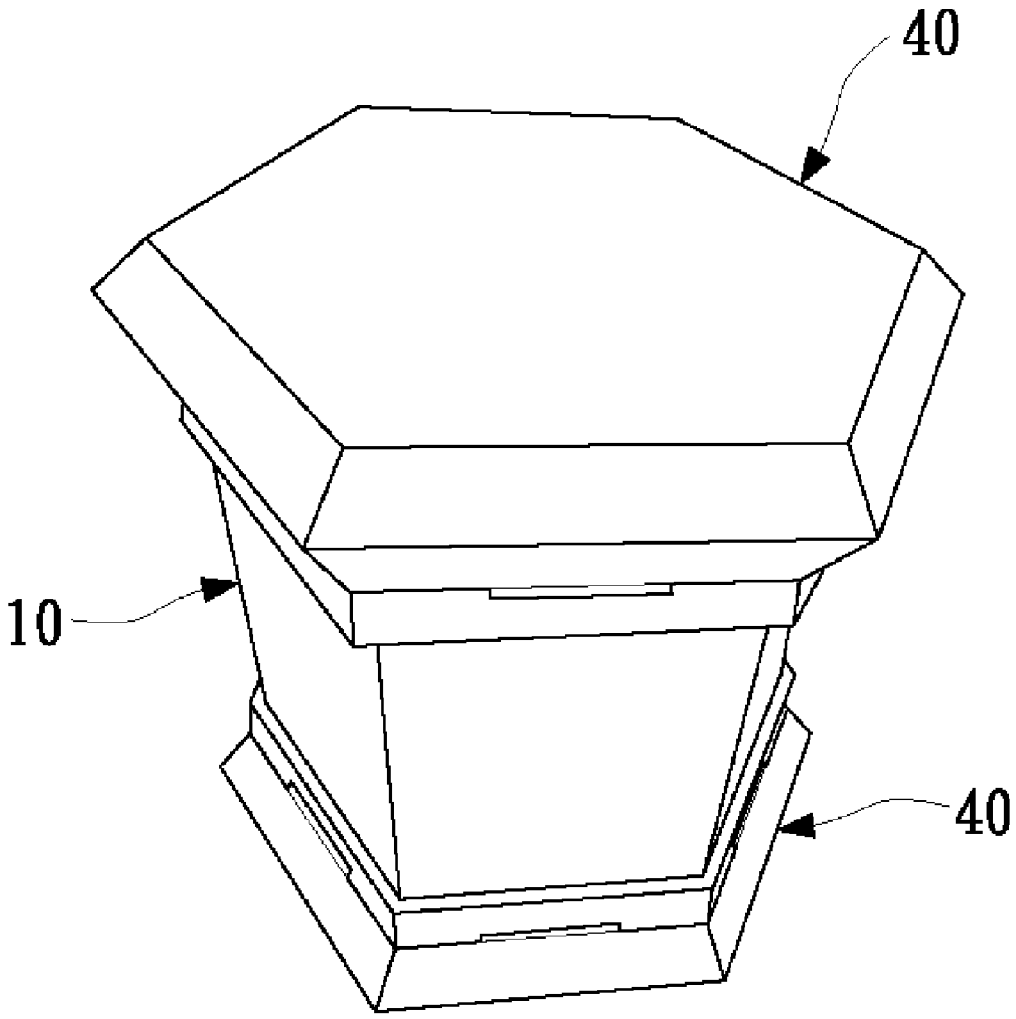
FIG. 6 is an appearance diagram showing a stool according to one embodiment of the invention.

FIG. 5 is an assembled diagram showing the stool according to one embodiment of the invention. In FIG. 5, the assembled seat portions 40 are then sleeved on one end of the supporting portions 10, respectively, thus to form the stool in the embodiment of the invention. FIG. 6 is an appearance diagram showing the stool according to one embodiment of the invention.

According to the stool in the embodiment of the invention, not only the corrugated paper but also manufacturers' costs can be saved. In addition, according to the structure design in the embodiment of the invention, carrying capacity and pressure resistance are improved, and the stool has the containing space capable of containing an object. Further, since the stool is assembled without adhesives or other assistant tools, it is more convenient in assembly, and the problem that other assistant objects are needed for assembling in the prior art can be solved.

Although the present invention has been described in considerable detail with reference to certain preferred embodiments thereof, the disclosure is not for limiting the scope of the invention. Persons having ordinary skill in the art may make various modifications and changes without departing from the scope and spirit of the invention. Therefore, the scope of the appended claims should not be limited to the description of the preferred embodiments described above.

What is claimed is:

1. A stool comprising:

a polygonal fixing portion including a plurality of inserting slots, each of the inserting slots located between two adjacent sides;

a plurality of supporting portions, each of the supporting portions including a supporting sheet and two inserting flaps, the inserting flaps extending from two sides of the supporting sheet and inserted into adjacent inserting slots to position the corresponding supporting portion at a side of the polygonal fixing portion; and a combining portion including a plurality of positioning slots, the positioning slots of the combining portion fastened to the inserting flaps to connect the supporting portions to form a polygonal column.

2. The stool according to claim 1, wherein the polygonal fixing portion comprises a plurality of corrugated boards.

3. The stool according to claim 2, wherein flute directions of the corrugated boards interlace with each other.

4. The stool according to claim 1, wherein the polygonal fixing portion further comprises a hollow through hole cooperating with the supporting portions to form a containing space inside the stool.

5. The stool according to claim 1, further comprising at least one covering flap disposed at one end of the supporting sheet for connecting with the inserting flaps.

6. The stool according to claim 5, wherein the covering flap comprises a fastening slot, and the inserting flaps are inserted into the fastening slot to be connected with the covering flap.

7. The stool according to claim 1, further comprising at least one seat portion sleeved on one end of each of the supporting portions.

8. The stool according to claim 7, wherein the seat portion comprises:

a main body portion including a plurality of connecting tabs; and a side portion including a first connecting element, a second connecting element, and a plurality of connecting holes, the first connecting element being connected with the second connecting element, the connecting tabs being inserted into the connecting holes to connect the main body portion and the side portion.

9. The stool according to claim 8, wherein the main body portion has a plurality of edges, and the connecting tabs are disposed at the edges, respectively.

10. The stool according to claim 8, wherein the side portion further comprises a plurality of positioning flaps, each of the positioning flaps includes a first positioning element and a second positioning element, and the first positioning element of one of the positioning flaps is engaged with the second positioning element of adjacent positioning flap to position the positioning flaps.

11. The stool according to claim 8, wherein the seat portion further comprises a strengthening sheet located at the side portion and attached to the main body portion.

* * * * *